US011492880B2

(12) United States Patent
Hansen

(10) Patent No.: US 11,492,880 B2
(45) Date of Patent: Nov. 8, 2022

(54) GAS OPERATED, RETRIEVABLE WELL PUMP FOR ASSISTING GAS LIFT

(71) Applicant: HANSEN DOWNHOLE PUMP SOLUTIONS A.S., Bryne (NO)

(72) Inventor: Henning Hansen, Bryne (NO)

(73) Assignee: HANSEN DOWNHOLE PUMP SOLUTIONS A.S., Bryne (NO)

( * ) Notice: Subject to any disclaimer, the term of this patent is extended or adjusted under 35 U.S.C. 154(b) by 0 days.

(21) Appl. No.: 17/202,201

(22) Filed: Mar. 15, 2021

(65) Prior Publication Data

US 2021/0198987 A1 Jul. 1, 2021

Related U.S. Application Data

(63) Continuation of application No. PCT/IB2019/057783, filed on Sep. 16, 2019.

(60) Provisional application No. 62/732,412, filed on Sep. 17, 2018.

(51) Int. Cl.
*E21B 43/12* (2006.01)

(52) U.S. Cl.
CPC ..... *E21B 43/122* (2013.01); *E21B 43/129* (2013.01)

(58) Field of Classification Search
CPC ..... E21B 43/121–13
See application file for complete search history.

(56) References Cited

U.S. PATENT DOCUMENTS

| | | | | |
|---|---|---|---|---|
| 4,405,291 | A | 9/1983 | Canalizo | |
| 2008/0257547 | A1 | 10/2008 | Vann | |
| 2018/0163526 | A1* | 6/2018 | Chidi | E21B 43/128 |

FOREIGN PATENT DOCUMENTS

| | | | |
|---|---|---|---|
| GB | 2410509 | A | 8/2005 |
| WO | 03/044318 | A1 | 5/2003 |

OTHER PUBLICATIONS

International Search Report, International Application No. PCT/IB2019/057783 dated Dec. 13, 2019.
Written Opinion of the International Search Authority, International Application No. PCT/IB2019/057783 dated Dec. 13, 2019.
Canadian Office Action dated May 24, 2022, for Canadian Application No. 3,111,970.
Examination Report dated Mar. 17, 2022, for United Kingdom Application No. GB2105241.0.

* cited by examiner

*Primary Examiner* — Kristyn A Hall
(74) *Attorney, Agent, or Firm* — Richard A. Fagin

(57) ABSTRACT

A method for producing fluid from a well includes inserting a pump into a well tubing having at least one gas lift valve disposed at a selected depth. The pump arranged to lift fluid below the pump into the well tubing. A gas pressure in an annular space between the well tubing and a well casing is increased until the gas reaches a flow port in the tubing proximate the pump. The pump is operated by continuing pumping gas so as to lift fluid from a subsurface reservoir to the selected depth of the at least one gas lift valve.

10 Claims, 3 Drawing Sheets

GAS OPERATED, RETRIEVABLE WELL PUMP FOR ASSISTING GAS LIFT

CROSS REFERENCE TO RELATED APPLICATIONS

Continuation of International Application No. PCT/IB2019/057783 filed on Sep. 16, 2019. Priority is claimed from U.S. Provisional Application No. 62/732,412 filed on Sep. 17, 2018. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of pumps used to lift fluid from subsurface wells. More particularly, the disclosure relates to well pumps operated by pressurized gas.

Some subsurface oil and gas producing wells require artificial lift to move fluids from an underground reservoir to the surface. A common artificial lift technique is so-called "gas lift." Gas lifting is typically performed by pumping gas into the annular space between a production tubing and a well casing or liner, where the gas is moved into the tubing from the annular space through one or more valves mounted along the tubing. These valves may be wireline replaceable, from so-called side pocket mandrels.

When a well is newly drilled, gas lift valves are placed at pre-determined depths according to calculations of optimum lifting of produced fluids for the early phase of the production. However, as fluid delivery capabilities and pressure in the underground reservoir change over time, the original depth of the gas lift valve(s) may not be optimum. Specifically, as reservoir pressure decreases, the static fluid level in the well drops, eventually making gas lift valves ineffective. Hence, to rectify this using methods known in the art, the tubing needs to be pulled out of the well and re-installed with one or several gas lift valve(s) at different depths than the initial depth(s). This is, not at least with respect to offshore wells, a costly operation which often will be a show-stopper for performing such tubing string replacement.

If a motorized pump can be mounted at a depth below the gas lift valve(s), such a pump can assist in the lifting of reservoir fluids to the gas lift valve(s) at their original depths, resulting in more efficient production to the surface. If a well is not equipped with gas lift valve(s), but able to handle pressurized gas in the annulus, then the described method can also be used by allowing fluid in the annulus be replaced by gas. Such a replacement can be done by allowing gas to push fluid into the tubing string via a communication path between the tubing and the casing, as for example in the form of a punched hole close to the production packer.

SUMMARY

One aspect of the present disclosure is a method for producing fluid from a well. Such a method includes inserting a pump into a well tubing having at least one gas lift valve disposed at a first selected depth. The pump is arranged to lift fluid below the pump into the well tubing. A gas pressure in an annular space between the well tubing and a well casing is increased until the gas reaches a flow port at a second depth in the tubing below the first depth and proximate the pump. The pump is operated by continuing pumping gas so as to lift fluid from a subsurface reservoir to the selected depth of the at least one gas lift valve. If no gas lift valves are installed, such valves if installed are not functioning or are replaced by plugs in the gas lift side-pocket mandrels, then the pump will pump fluids into the tubing above the pump hang-off and from there to the surface.

In some embodiments, the pump is inserted into the tubing after the tubing is completely inserted into the well.

In some embodiments, the flow port is opened at a gas pressure exceeding an opening pressure of the at least one gas lift valve.

In some embodiments, the flow port forms part of a gas lift valve.

In some embodiments, the flow port comprises a sliding sleeve.

In some embodiments, the flow port comprises the inlet in a gas lift mandrel where the gas lift valve is removed.

DETAILED DESCRIPTION

The present disclosure describes a gas operated pump that uses compressed gas in the annulus and is suitable for use with a well having gas lift valves. The pump can be deployed, e.g., by electrical cable ("wireline"), coiled tubing, slickline or any other suitable deployment method to a selected depth in the tubing such as below the lowest gas lift valve, at a location where a gas pressure port from the annulus to the tubing is located. The pump may also be deployed to a much greater depth below an annular seal between the tubing and well casing or liner, i.e., a production packer.

A similar method can also be used if a tubing is retrieved and re-installed, where a dedicated tube for moving pressurized gas from the wellhead to the pump receptacle can be placed externally on the tubing. An example of a pump that can be used for the foregoing methods is described in U.S. Pat. No. 8,991,504 issued to Hansen.

Figures 1, 2:
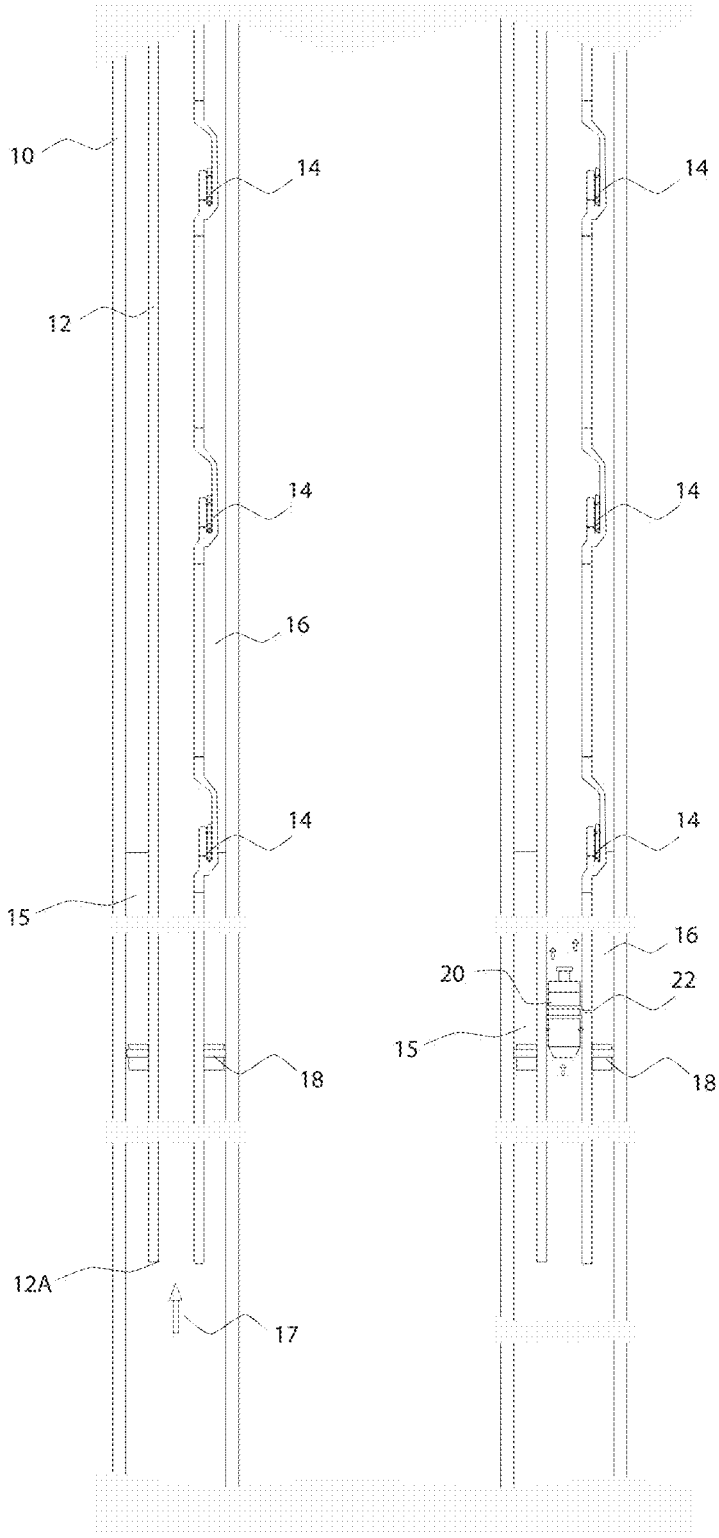
FIG. 1 is a schematic of a typical wellbore completion, illustrating gas lift valves located at various depths along a tubing.
FIG. 2 is a schematic of a typical wellbore completion, illustrating gas lift valves located at the various depths in FIG. 1, plus a gas operated pump placed in the tubing below the lowest gas lift valve.

FIG. 1 is a schematic diagram of a wellbore completion used in artificial lift applications, illustrating gas lift valves 14 located at various depths along a tubing 12. The tubing 12 is disposed in a casing or liner 10 and thereby defines an annular pace (annulus) 16. The annulus 16 may be hydraulically isolated from the interior of the tubing 12 by an annular seal such as a packer 18. The annulus 16 is filled with compressed gas from the surface (i.e., through a valve in a wellhead) to the depth of the lowermost gas lift valve 14. Fluid 15, which may include water produced from a subsurface reservoir (not shown separately) may be located in the annulus 16 below the lowest gas lift valve 14. Produced fluids 17 from the underground reservoir(s) enters into the lowest entry point 12A in the tubing 12. The gas lift valves 14 assist lifting this fluid 17 to the surface by reducing its effective density as a result of introducing the gas into the fluid 17 in the tubing. The gas lift valves 14 have a predetermined opening pressure, that is, they remain closed until the gas pressure in the annulus 16 exceeds the opening pressure, at which time gas can flow through the opened gas lift valve(s) 14 into the tubing 12. This operation is well understood by those skilled in the art or artificial lift. The gas lift valves 14 may each have an opening pressure related to the deployment depth of each gas lift valve 14. As may be understood with reference to FIG. 1, as gas pressure in the annulus 16 is increased, e.g., by increasing a pumping rate at the surface, gas may open successively deeper gas lift valves 14 and thereby enter the tubing 14 at successively greater depth. Fluid from a subsurface reservoir (not shown) may enter the casing 10 below the bottom 12A of the tubing 12, and may enter the tubing 12 through the bottom 12A.

FIG. 2 shows the well completion of FIG. 1 that includes a pump 20, which may be a motorized pump disposed in the tubing 12 below the lowermost (deepest) gas lift valve 14. The pump 20 may be a gas operated pump, for example one described in U.S. Pat. No. 8,991,504 issued to Hansen. Such pump may be operated by cycling gas pressure in the annulus 16. Other types of pump may be operated by continuous, steady state flow of gas through the annulus 16.

The pump 20 may be installed as a fixed part of the tubing 14, e.g., by threaded coupling, or as in the present example embodiment, the pump 20 may be installed in the tubing 12 after the well has been completed, that is, after the tubing 12 is fully installed in the well casing or liner 10 and the packer 18 is set in the casing or liner 10. For example, wireline, coiled tubing, slickline or semi-rigid spoolable rod can be used to retrieve and install the pump 20 in the tubing 12. The pump 20 may be arranged so that its working fluid inlet (not shown separately) accepts the produced fluid 17 and its working fluid outlet (not shown separately) is directed into the tubing 12 toward the surface.

The pump 20 may be installed in or proximate a device 22 disposed in the tubing 12 that enables movement of gas in the annulus 16 to a power fluid inlet on the pump 20. The device 22 may in general be described as having a gas port through the wall of the tubing 12. The device 22 may be, for example, a sliding sleeve or ported sub of any type known in the art. In some embodiments, the device 22 may comprise a valve operated by changing gas pressure in the annulus 16. In some embodiments, the device 22 may be a gas lift valve, e.g., disposed in a side pocket mandrel and having an opening pressure greater than the opening pressure of the lowest (deepest) gas lift valve 14. The device 22 may comprise one or several communication ports (not shown separately) that allow gas to move from the annulus 16 to inside the tubing 12 and thereby to the pump 20, or as in the case of a gas lift valve, may comprise the communication port directly. If the pump 20 is of a type that is retrievable after emplacement, the device 22 may comprise one or several seals located above and below the device 22 so that the tubing 12 operates as shown in FIG. 1 in the absence of the pump 20.

During production from the well, should it prove necessary to provide more lift than is possible using the gas lift valves 14, gas pressure in the annulus 16 may then be increased from the surface by increasing a pumping rate of the gas into the annulus 16. In such event, the gas is pushed all the way down to the depth of the pump 20. At such time, the pump 20 may then be operated by the flow of gas into the power fluid inlet (not shown separately) to assist in lifting produced fluids 17 to the gas lift valve(s) 14. In some embodiments, at the time the additional lift is needed, the well may be reconfigured from what is shown in FIG. 1 by installing the pump 20 into the tubing 12 such as by any of the foregoing example conveyance methods. After such installation, the pump 20 may be operated as explained above by increasing gas pressure in the annulus 16.

Figure 3:
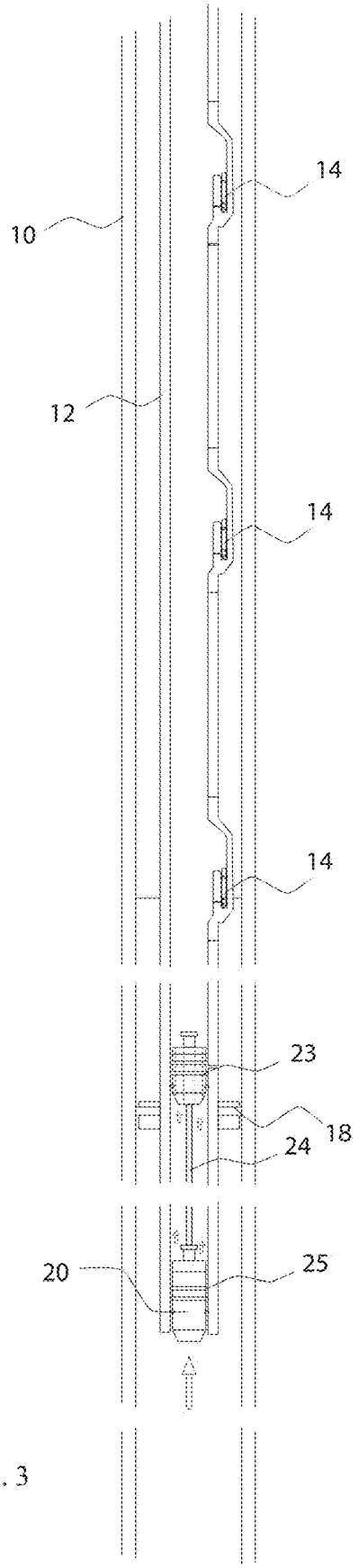
FIG. 3 is a schematic of a wellbore completion, illustrating that a hang-off and externally sealing device is placed above the production packer, where a hydraulic tube from this hang-off transport gas to the pump placed further down in the wellbore tubing.

In some cases, it may be desirable to insert the pump to a greater depth than may be configured with any form of flow port (e.g., a gas lift valve) within the tubing. FIG. 3 shows schematically a wellbore completion as similar to those shown in FIGS. 1 and 2, further illustrating that a hang-off and external sealing device 23 may be placed in the tubing 12 above the production packer 18. The hang-off and external sealing device 23 may have internal flow porting to do the following: enable movement of gas from the annulus 16 through a flow port, e.g., a gas lift valve mandrel and direct the gas to the pump 20; and enable flow from the pump 20 to pass through the hang-off and external sealing device 23 upwardly in the tubing. In the present example embodiment, the gas may be directed to a hydraulic tube 24 that extends from the hang-off and external sealing device 23. The hydraulic tube may both transport gas to the pump 20, which in the present embodiment is placed further down in the tubing 12, and suspend the pump 20 in the tubing. The pump 20 may comprise an outer sealing system 25, which will result in fluids discharged from the pump 20 moving upwardly through the tubing 12, to above the pump 20 and continuing to move upwardly through the hang-off and external sealing device 23.

Figure 4:
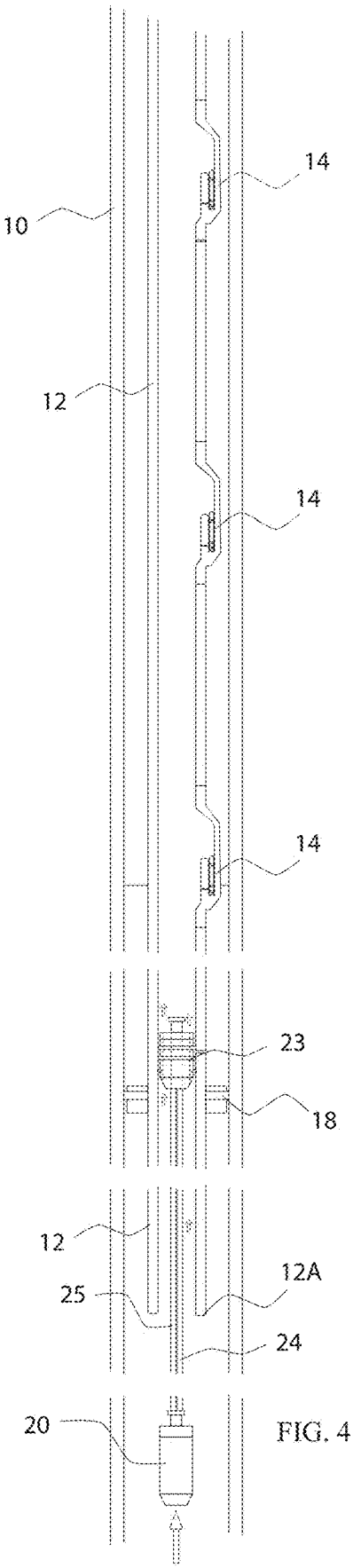
FIG. 4 is a schematic of a wellbore completion, illustrating that a pump are placed deeper into the wellbore, past the lower end of the production tubing.

FIG. 4 is a schematic of a wellbore completion similar to those shown in the previous figures, further illustrating that a pump 20 may be placed deeper into the wellbore, in the present embodiment below the bottom 12A of the tubing 12. Power fluid to operate the pump 20, in the form of gas from the annulus 16 between the tubing 12 and the casing 10, may be conducted to the power fluid inlet of the pump 20 via the hydraulic tube 24 as in FIG. 3, and produced fluids are transported from the pump 20 to above the hang-off and sealing device 23 through a discharge tube 25 extending between the pump outlet and the hang-off and external sealing device 23. The discharge tube 25 may extend through the pack-off and external sealing device 23 so that produced fluids from the pump 20 are transported to the upper side of the hang-off and external sealing device 23 toward the surface. The hang-off and external sealing device 23 may contain a check valve with a fluid and gas conduit passing through the hang-off and external sealing device 23, allowing produced fluids and gas to flow freely through the hang-off and external sealing device 23. Such a function will be beneficial when the well starts naturally producing again from the subsurface reservoir due to reduced hydrostatic pressure against the reservoir by fluid lifted by the here described pump system.

Figure 5:
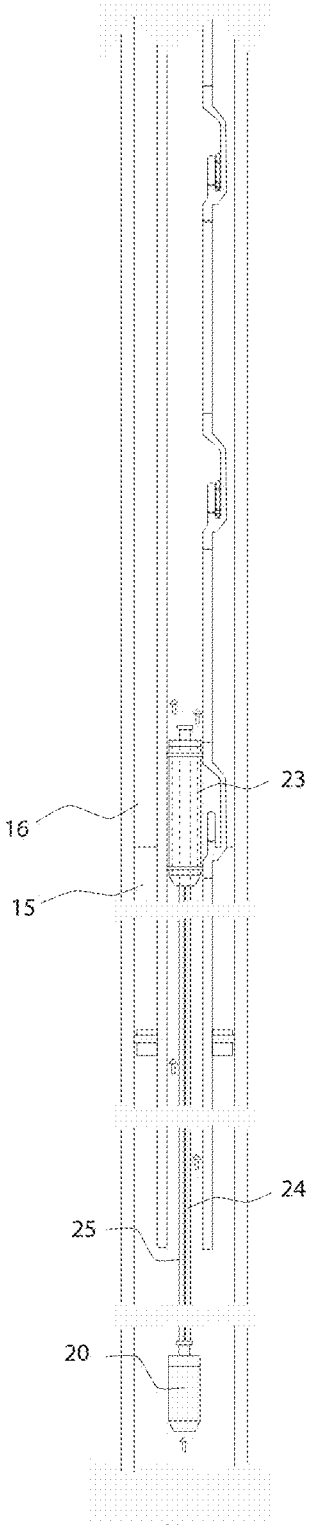
FIG. 5 shows a similar configuration to that in FIG. 4, where a hanger/pack-off system is placed across a side pocket mandrel, receiving power gas for the pump from the mandrel where a gas lift valve is removed.

FIG. 5 shows an arrangement similar to that shown in FIG. 4, where a hanger/pack-off system 23 is placed across a side pocket mandrel, shown where one of the gas lift valves 14 may have been placed, receiving power fluid in the form of gas from the annulus 16 from the gas lift mandrel where a gas lift valve has been removed.

In the embodiments described with reference to FIGS. 3, 4 and 5, the hang-off and external sealing device 23 may comprise a pressure or compression actuated setting element, such as are used on retrievable packers, plugs and related wellbore devices known to be conveyed into a well by wireline, coiled tubing, slickline, semi-stiff spoolable rod or any other well conveyance known in the art. A possible benefit of using such a setting element is that the hang-off and external sealing device 23, as well as the pump 20 may be conveyed to the selected depth in the well using conveyances as described above, thus eliminating the need to remove the tubing 12 from the well.

A method according to the present disclosure may reduce the need to pull tubing and reconfiguring gas lift valves in the event reservoir pressure decreases so as to make one of more of such gas lift valves ineffective. Such methods may extend the useful lifetime of a well without the need to remove production tubing or similar tubulars from the well.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for producing fluid from a well, comprising:

inserting a pump into a well tubing proximate a depth of at least one gas lift valve in the well tubing such that a power fluid inlet in the pump is in fluid communication with a port in the tubing associated with the at least one gas lift valve, the tubing nested within a casing, the tubing and the at least one gas lift valve fully installed in the casing prior to inserting the pump;

moving gas from an annulus between the tubing and the casing through the port to operate the pump to lift fluid from below the tubing toward the surface.

2. The method of claim 1 wherein the pump fluidly isolates an interior of the well tubing from the at least one gas lift valve.

3. A method for producing fluid from a well, comprising:

inserting a pump into a well tubing having at least a first gas lift valve disposed at a first selected depth and at least a second gas lift valve disposed at a second selected depth lower than the first selected depth, the pump arranged to lift fluid below the pump into the well tubing, wherein the pump is inserted into the tubing after the tubing is completely inserted into the well; and increasing a pressure of gas in an annular space between the well tubing and a well casing until the gas reaches the at least a second gas lift valve, wherein the at least a second gas lift valve fluidy connects the annular space and the tubing; and operating the pump by continuing pumping gas into the annulus and through the at least a second gas lift valve to a power fluid inlet of the pump so as to lift fluid from a subsurface reservoir to the selected depth of the at least a first gas lift valve.

4. The method of claim 3 wherein the pump is inserted using at least one of wireline, slickline, coiled tubing and semi-stiff spoolable rod.

5. The method of claim 3 wherein the flow port is opened at a gas pressure exceeding an opening pressure of the at least a first gas lift valve.

6. The method of claim 3 wherein the pump is inserted into the well tubing to a pump depth disposed below the at least a second selected depth, and a power fluid inlet of the pump is sealingly fluidly connected to the at least a second gas lift valve by a hydraulic tube extending from the pump to a hang off and external sealing device disposed proximate the second selected depth and arrange to fluidly isolate an interior of the well tubing from the at least a second gas lift valve.

7. A method for producing fluid from a well, comprising:

inserting a pump into a well tubing proximate a depth of at least one side pocket mandrel in the well tubing such that a power fluid inlet in the pump is in fluid communication with a port in the at least one side pocket mandrel, the tubing nested within a casing, the tubing and the at least one side pocket mandrel fully installed in the casing prior to inserting the pump;

moving gas from an annulus between the tubing and the casing through the at least one side pocket mandrel to operate the pump to lift fluid from below the tubing toward the surface.

8. The method of claim 7 wherein the pump is inserted into the well tubing to a pump depth disposed below the at least one side pocket mandrel, and a power fluid inlet of the pump is sealingly fluidly connected to the at least one side pocket mandrel by a hydraulic tube extending from the pump to a hang off and external sealing device disposed proximate the at least one side pocket mandrel and arranged to fluidly isolate an interior of the well tubing from the at least a second gas lift valve.

9. The method of claim 7 wherein the pump fluidly isolates an interior of the well tubing from the at least one gas lift valve.

10. The method of claim 7 wherein a gas lift valve is removed from the at least one side pocket mandrel before the inserting the pump.

* * * * *